US005609178A

United States Patent [19]

Hennig et al.

[11] Patent Number: 5,609,178

[45] Date of Patent: Mar. 11, 1997

[54] PRESSURE-ACTUATED VALVE AND METHOD

[75] Inventors: Gregory E. Hennig, Aberdeen, Scotland; Gary J. Pape, Ellow, United Kingdom

[73] Assignee: Baker Hughes Incorporated, Houston, Tex.

[21] Appl. No.: 535,846

[22] Filed: Sep. 28, 1995

[51] Int. Cl.[6] ..... E21B 34/10

[52] U.S. Cl. ..... 137/10; 137/12; 137/115.09; 137/115.24; 137/624.14; 166/317; 166/319; 166/332.1

[58] Field of Search ..... 137/115, 117, 137/624.14, 10, 12; 166/317, 319, 332.1

[56] References Cited

U.S. PATENT DOCUMENTS

| | | | |
|---|---|---|---|
| 2,793,908 | 5/1957 | Carver | 137/624.14 X |
| 3,378,068 | 4/1968 | Page | 166/319 X |
| 3,986,554 | 10/1976 | Nutter | 166/319 |
| 4,095,611 | 6/1978 | Hetz | 137/115 |
| 4,491,187 | 1/1985 | Russell | 166/241 |
| 4,609,005 | 9/1986 | Upchurch | 166/317 X |
| 4,718,494 | 1/1988 | Meek | 166/319 X |
| 4,729,406 | 3/1988 | Frentzel | 137/624.14 |
| 4,848,488 | 7/1989 | Cendre et al. | 175/61 |

FOREIGN PATENT DOCUMENTS

| | | | |
|---|---|---|---|
| 0409446A1 | 1/1991 | European Pat. Off. . | |
| 2214540 | 9/1989 | United Kingdom | 166/319 |
| 93/10328 | 5/1993 | WIPO | 166/319 |

OTHER PUBLICATIONS

Baker Oil Tools, Flow Control Systems, Model "D" Ported Bypass Seating Nipple Product No. 800–50, 1 pg.

*Primary Examiner*—Stephen M. Hepperle
*Attorney, Agent, or Firm*—Browning Bushman

[57] ABSTRACT

A downhole valve 10 opens or closes a bypass (12,13) in response to the pressure of the fluid in the valve. The valve housing body 14 is adapted for fluid communication with a tubular within a well bore. The valve bypass may be repeatedly cycled from open to closed position by selectively raising and lowering the fluid pressure. A replaceable flow restriction 18 in the valve is sized to produce a desired flow-induced pressure drop across the valve to cycle the valve with fluid flow. Differential sealing areas (11c and 15,16) are provided to cycle the valve by varying the static fluid pressure in the valve. According to the method, a flowing fluid pressure drop induced by fluid flow through the valve is used to change the state of the valve, and a subsequent change in hydrostatic fluid pressure or fluid pressure is used to return the valve to its original state.

28 Claims, 2 Drawing Sheets

PRESSURE-ACTUATED VALVE AND METHOD

FIELD OF THE INVENTION

The present invention relates generally to pressure-activated fluid valves. In the specific application herein described, the present invention relates to a remotely controlled downhole fluid bypass valve to perform work used in the drilling, completing or servicing of oil and gas wells.

BACKGROUND OF THE INVENTION

Subsurface valves are employed to perform a variety of services or tasks in the drilling, completion and production of oil and gas wells. In the performance of this work, it is frequently necessary to manipulate the valve from its open to its closed condition, or vice versa, while the valve is at its subsurface location. In opening or closing a valve carried by a tubular pipe string, a ball or pump down plug may be inserted into the string at the well surface and pumped down to the valve, where it creates a pressure increase to shift the valve from its closed to open condition, or vice versa. While this technique for change of the valve state is simple and effective, it is not easily employed where the pipe string contains a wire line or other internal obstruction. Moreover, the described system is usually limited in the number of times the valve condition may be changed without withdrawing and resetting the valve. Another technique for changing the valve state is to lower a wireline tool to the valve. This procedure is time-consuming and requires additional surface-operating equipment such as a wireline unit and a wireline lubricator.

One prior art system employs hydrostatic pressure changes in the fluid to shift the subsurface valve between open and closed positions. The prior art valve may be cycled several times by pressuring up and bleeding off the pressure of the fluid in the pipe string before having to be retrieved and reset.

Another prior art system, described in European Patent Application No. 90307273.4 (Publication No. 0409446A1) employs a flow-responsive shifting mechanism to alternately lock or release a subsurface tool. Monitoring the flowing fluid pressure provides a surface indication of the locked or unlocked status of the tool. Tool activation is accompanied by the application or reduction of forces acting through the pipe string supporting the tool. U.S. Pat. No. 4,491,187 describes a pressure-actuated downhole tool carded on a drill string that can be repeatedly cycled between expanded, intermediate and retracted positions by cycling the drill string pressure.

Prior art valves which are capable of remotely opening and closing the downhole valve using a ball or pump down plug to increase fluid pressure are limited in their uses and cannot be easily recycled between open and closed positions. Pressure activated downhole tools which may be repeatedly cycled are generally complex and expensive. Accordingly, well operators have generally sacrificed the advantage of repeated cycling of a downhole valve in favor of the high reliability and lower costs associated with valves which utilize a ball or pump down plug to create the pressure differential required to shift the downhole valve.

The disadvantages of the prior art are overcome by the present invention. An improved pressure-activated bypass valve and method of cycling a downhole valve are hereinafter disclosed. The valve and method of the present invention are particularly well suited for hydrocarbon recovery operations when high reliability is required.

SUMMARY OF THE INVENTION

The valve of the present invention provides a bypass opening which may be cycled between its open and closed positions as many times as desired without having to reset the valve at the well surface. The bypass of the valve may be shifted from open to closed or from closed to open by controlling the flow rate of the fluid passing through the valve body. The valve bypass may also be shifted from closed to open by controlling the hydrostatic pressure of the fluid acting within the valve in the absence of fluid flow through the valve body. Mechanical retaining cam members are provided to mechanically retain the bypass in either its open or its closed position in the absence of fluid flow through the valve body.

A specially sized and replaceable flow restrictor is included with the valve to produce a desired pressure drop created by fluid flowing through the valve body. This flow-induced pressure drop through the valve body moves a valving sleeve axially against a spring which in turn shifts the sleeve axially back when the fluid flow rate drops. When there is no flow through the valve body, an increase in the hydrostatic pressure of the fluid within the valve acts across differential sliding seal areas in the valve body to shift the sleeve against the spring. The spring pushes the sleeve axially back when the hydrostatic pressure is relieved. The flow and pressure sequence may be repeated as often as desired to repeatedly cycle the valve bypass between its open and closed positions.

Where the valve body is open to flow, the bypass opening may be cycled between open and closed conditions by simply increasing the flow rate of fluid through the valve body and then reducing the flow rate to allow the spring to shift the sleeve to the bypass open or closed position. When flow through the valve body is restricted or completely stopped, the bypass may be opened by increasing and then reducing the hydrostatic pressure of the fluid to shift the sleeve into the bypass open position.

The flow restricting portion of the valve may be sized to respond to different well fluids and flow rates to produce the desired pressure drop and resulting movement of the valving sleeve. The valve operation sequence may also be varied to meet special applications by providing one or more sequential closed bypass positions without an intermediate open bypass position, or one or more opened bypass positions without an intermediate closed bypass position.

In the event of a valve malfunction or as required to perform a desired subsurface operation, a pressure-actuated bypass opens to permit circulation of fluid through the valve when the pressure differential across the valve body exceeds normal operating limits.

From the foregoing it will be appreciated that an important object of the present invention is to provide a remotely operated bypass in a subsurface valve that may be repeatedly opened or closed by surface controlled pressure and flow variations in the fluid contained within the valve. It is a related object of the present invention to provide a method for opening and closing a bypass in a subsurface valve with surface controlled variations in both the flow rate and the pressure of the fluid in the valve.

Another object of the method of this invention is to change the state of a closed bypass in a valve with hydrostatic pressure changes in a non-flowing fluid contained within the valve body and to change the state of an open bypass in a valve with flow-induced pressure changes in a fluid flowing through the valve body. An operator may control both the hydrostatic pressure changes and the flow-induced pressure changes from a location remote from the valve.

It is a feature of this invention is to provide a valve with a flow restriction member which can be easily and quickly replaced to provide a desired response to the flow of fluid through the valve body. A further feature of the invention is a remotely controlled bypass valve with a flow restriction that can be configured to provide a desired bypass actuating pressure drop for a particular fluid and flow rate.

It is also a feature of the present invention that the remotely controlled bypass in a valve employs the fluid being controlled by the valve as the medium which shifts the valve bypass between open and closed positions. A related feature is that the valve provides a secondary bypass that may be opened with the same fluid medium to permit bypass flow through the valve in the event of a control failure in the primary bypass.

It is a significant advantage of this invention that the subsurface bypass may be repeatedly opened and closed by varying fluid conditions at the surface.

Another advantage of the invention is that the bypass may be included in a valve positioned downhole along a tubular string, and may be used to control various operations of other downhole equipment.

These and further objects, features and advantages of the present invention will become apparent from the following detailed description wherein reference is made to the figures in accompanying drawings.

DETAILED DESCRIPTION OF THE PREFERRED EMBODIMENTS

Figure 1:
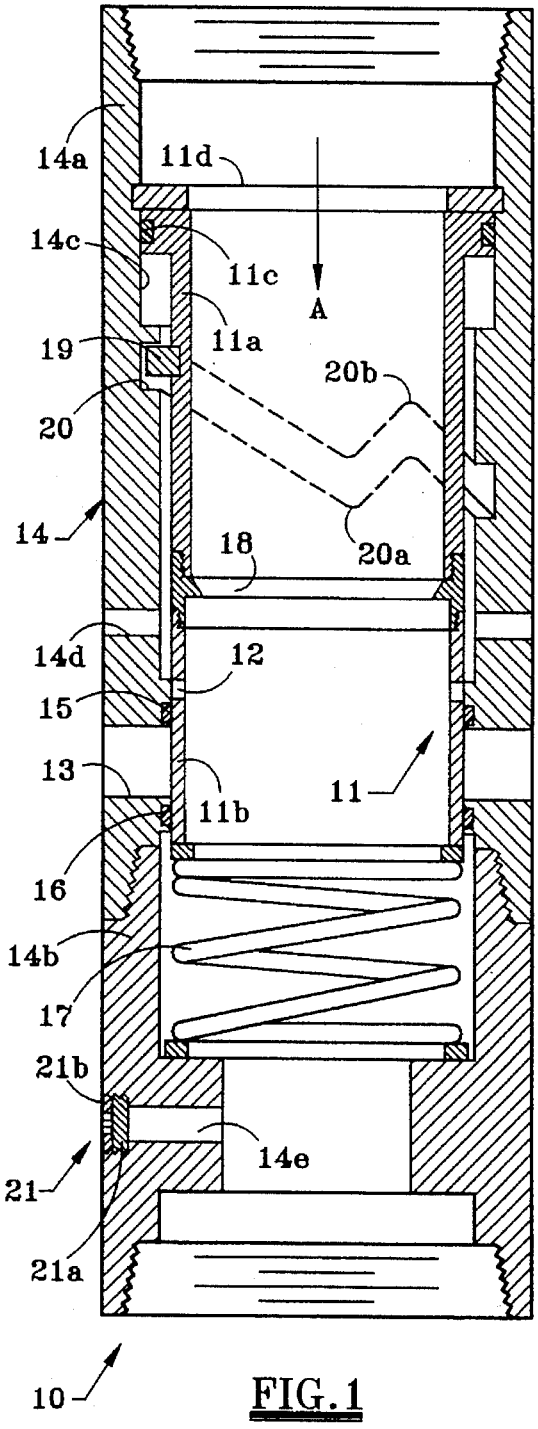
FIG. 1 is a vertical sectional view illustrating a preferred embodiment of the valve bypass of the present invention in its closed position.

FIG. 1 of the drawings illustrates a valve 10 of the present invention with the bypass in its closed condition. The valve 10 is threaded at its top end where it is adapted to be connected to a tubular fluid conductor (not illustrated) such as a string of coil tubing, a work string or other well tubular. A well tool or other apparatus (not illustrated) may be attached to the valve by threads at the bottom of the valve 10 to perform a desired well servicing or completion task.

Figure 2:
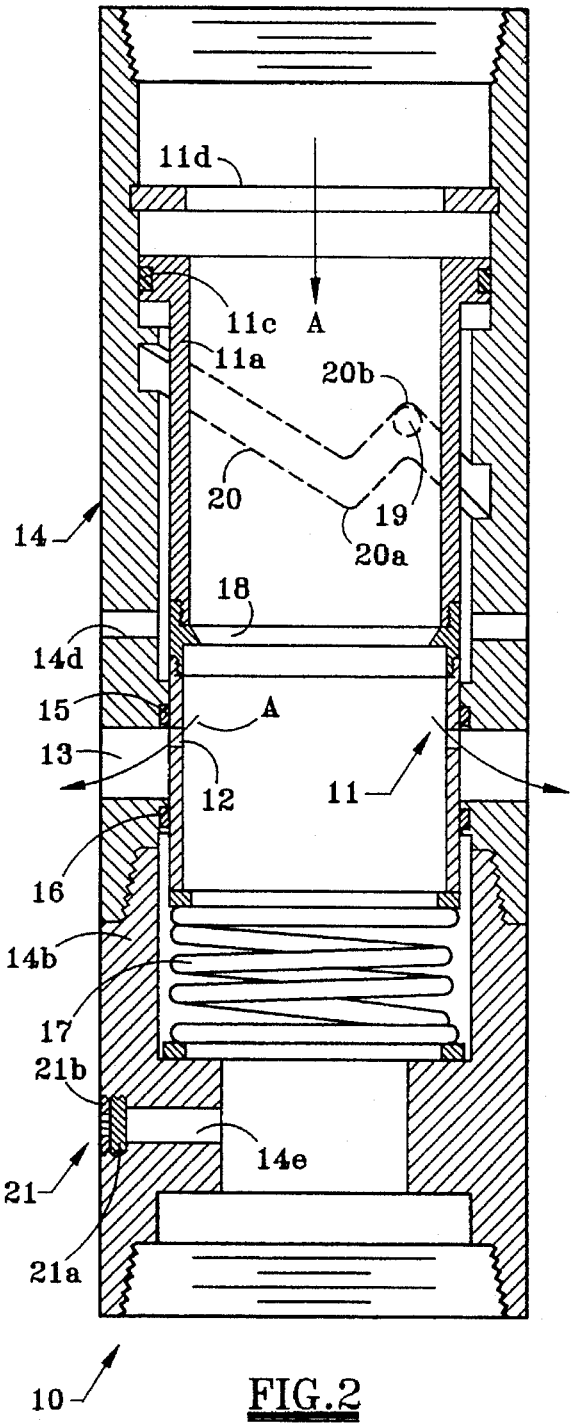
FIG. 2 is a vertical sectional view of the valve bypass of FIG. 1 illustrated in its open position.

Fluid is forced through the well tubular and into the valve 10 in the direction of the arrows A by a surface pump. The fluid entering the top of the valve 10 flows axially through a central tubular sleeve assembly, indicated generally at 11 and, as illustrated in FIG. 2, bypassed out of the sleeve assembly through radial ports 12 formed in a sleeve wall and then through connecting radial ports 13 formed in a wall of a surrounding tubular valve housing body 14. The housing 14 includes an upper sleeve housing section **14*a* which is threadedly engaged with a lower spring housing section 14*b***.

Circumferentially extending O-ring seals 15 and 16, respectively carded in the valve housing 14 above and below the ports 13, provide a pressure-tight seal between the sleeve assembly 11 and the housing 14.

FIG. 2 illustrates the valve 10 with the bypass in its open position with the sleeve assembly 11 shifted to an intermediate lower position within the housing 14 whereby the housing ports 13 are open to the sleeve ports 12. The valve 10 is shifted from its open position, illustrated in FIG. 2, to its closed position, illustrated in FIG. 1, by pumping fluid through the valve body at a rate sufficient to move the sleeve assembly 11 downwardly against the biasing force of a spring 17. This downward force is produced as the fluid flowing through the valve passes through a central passage in a flow-restricting ring 18 included as a part of the sleeve assembly 11. The sleeve assembly 11 includes a piston section **11*a* and a valve section 11*b* which are threadedly engaged with the ring 18 whereby the entire assembly moves as a unit within the housing 14. The spring 17 and the flow passage design through the ring 18 are selected for the type of fluid and the desired pumping conditions to be encountered to produce a flow-induced pressure drop across the valve 10 that is sufficient to move the sleeve 11 against the spring force. The ring 18 and spring 17 are removably received within the valve 10** to permit them to be changed as required for a particular application.

Figure 3:
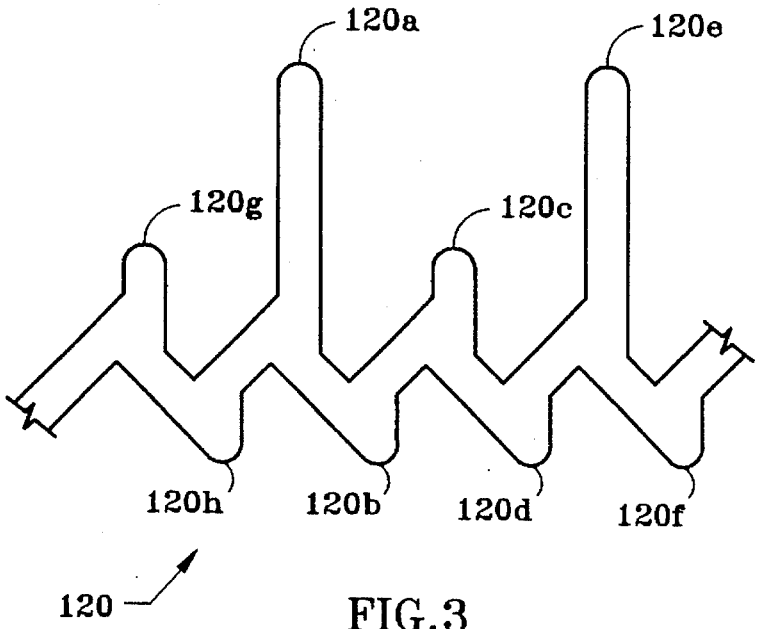
FIG. 3 is a schematic depiction of a caming pattern of the valve of the present invention producing sequential open and closed bypass cycles.
Figure 4:
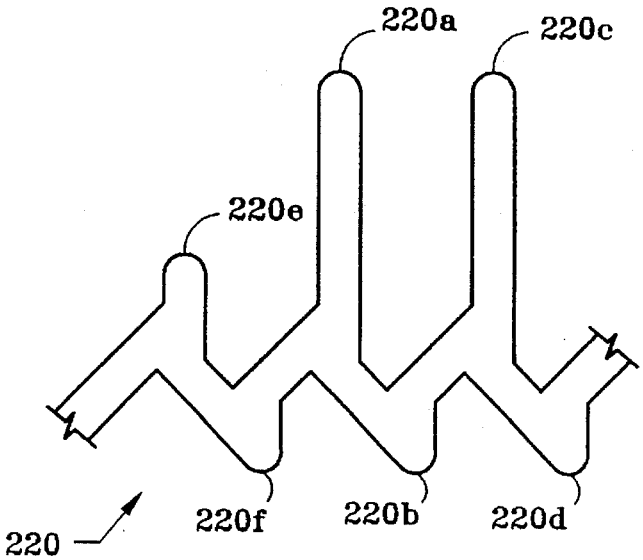
FIG. 4 is a schematic representation of an alternative caming pattern producing one closed and two open valve bypass positions in each control sequence.
Figure 5:
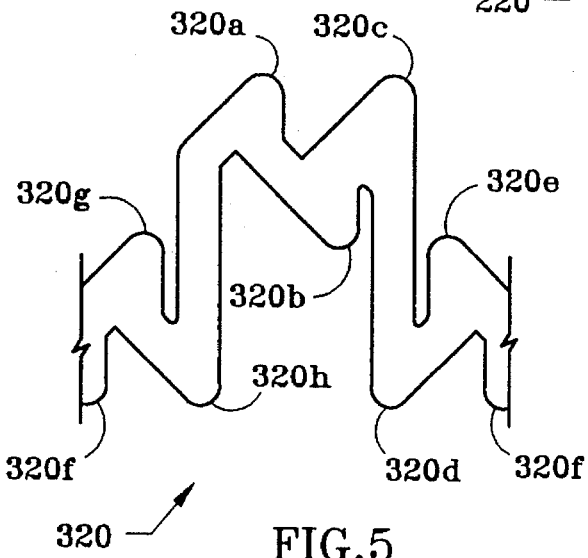
FIG. 5 is a schematic depiction of a preferred form of the caming pattern of the present invention producing sequential open and closed bypass positions separated by mechanically retained open and closed positions.

Axial movement of the sleeve assembly 11 is accompanied by a rotational sleeve movement that results from movement of a sleeve key 19 through a cam slot 20 formed on the internal surface of the valve housing 14. The cam slot design is schematically represented in FIGS. 1 and 2 for purposes of describing the cooperative interaction between the sleeve assembly 11 and the valve housing 14. The dimensions and contours of the cam slot pattern are selected to move the valve sleeve assembly between axial locations within the valve body to selectively open or close the bypass and to mechanically hold the sleeve in a bypass open or bypass closed position. Preferred embodiments of the cam slot configuration are illustrated in FIGS. 3, 4 and 5.

The piston section **11*a* of the sleeve assembly 11 is equipped with an annular seal ring 11*c* which forms a sliding, sealing engagement between the piston section 11*a* and a surrounding bore section 14*c* formed within the upper housing section 14*a*. Pressure communication from the annular area between the piston section 11*a* and the area outside of the valve 10 is provided through radial ports 14*d* formed in the wall of the housing section 14*a*. A snap ring 11*d* holds the assembly 11 within the housing 14**.

The cross sectional sealing area of the seal ring 11 c is greater than the cross sectional sealing area of the o-rings 15 and 16. As a result, when pressure acting within the sleeve assembly 11 is higher than the pressure acting externally of the assembly 11, a net force is provided which tends to move the assembly 11 downwardly through the housing 14. Conversely, when the pressure externally of the housing 14 is greater than that within the sleeve assembly 11, a net upwardly directed, pressure induced, force acts on the sleeve assembly 11. Where the pressure of the fluid inside and outside of the valve is the same, a net upward force is exerted on the sleeve assembly 11 by the spring 17 biasing the sleeve to the bypass closed position.

A shear disk assembly 21 is provided in the housing section 14*b* to re-establish circulation through the valve body 14 in the event the normal valve control fails to reopen the closed bypass of the valve 10. The assembly 21 includes a flat, circular shear disk 21*a* held in place by an externally threaded, centrally ported retaining ring 21*b*. The ring 21*b* is received within the internally threaded end of a radial port 14*e* which extends through the wall of the spring housing section 14*b*. The central port of the ring 21*b* may be equipped with suitable flat-faced surfaces to engage an allen wrench or other tool as required to screw the ring into the port 14*e*.

In operation, a subsurface tool such as an inflatable well packer or a plug puller is attached to the lower end of the valve housing 14 in fluid communication with the valve. The upper end of the valve housing 14 is attached to a tubular string such as coil tubing, which extends to the surface. With the valve 10 in its open condition, such as illustrated in FIG. 2, the valve 10 may be lowered into the well while fluid bypass circulation is maintained through the valve. This fluid bypass circulation may be required, for example, to wash sand up to the well surface or to otherwise condition the well to freely receive the assembly 10 or for some other necessary purpose.

The central passage through the flow restricting ring 18 is dimensioned and configured to allow a desired fluid flow for adequate circulation of fluid back to the well surface.

When the flow rate of the fluid moving through the valve 10 produces a sufficient pressure drop across the ring 18, the flow induced pressure forces acting on the sleeve assembly 11 compress the spring 17 and force the sleeve assembly to move downwardly through the housing 14. The key 19 follows the cam slot 20 causing the sleeve assembly 11 to rotate until the key lands at a slot bottom position (not visible in FIG. 2) similar to the position 20*a* at which the bypass of the valve is open. When the fluid flow rate is reduced sufficiently, the spring 17 shifts the assembly 11 and key 19 up into a top slot position as illustrated in FIG. 1 where the valve bypass is held in a closed position even after the flow terminates or the surface pressure is fully relieved.

With the bypass closed, all fluid flowing through the valve 10 is communicated through the valve 10 to the tool or equipment attached below the valve. This tool or equipment could be, for example, a fluid driven drilling motor, an inflatable packer, a downhole anchor or other pressure actuated device or system. If the main flow passage below the valve is closed to fluid flow, hydrostatic pressure controlled from the surface acts on the tool or equipment carried below the valve.

When it is desired to open the bypass through the valve, for example, to circulate cuttings to the surface without operating a fluid driven motor attached below the valve or to deflate a packer or to disengage or release a subsurface component, the hydrostatic pressure or the fluid flow rate through the valve body is raised sufficiently to shift the sleeve assembly 11 down against the spring 17. The engagement of the key 19 in the cam slot 20 causes the sleeve to rotate as the key moves to the next low cam position 20*a* where the bypass remains open as long as the increase flow rate or pressure are maintained. When the pressure or flow rate through the valve 10 is sufficiently relieved relative to the pressure acting externally of the valve, the force of spring 17 moves the key 19 and attached sleeve assembly 11 up into a high cam position 20*b* similar to the position of FIG. 2 where the bypass of the valve is held in open condition with the ports 13 and 12 in fluid communication.

In the event the bypass of the valve 10 will not return to its open position, bypass circulation through the valve body may be established by applying pressure to the valve 10 from the surface until the shear disk 21*a* ruptures to establish a flow path through the port 14*c*. The assembly 21 thus acts as a secondary control to establish fluid communication across the valve housing. The material and dimensions of the disk 21*a* are selected to withstand pressures in normally expected operating ranges and to rupture when the pressure differential across the disk exceeds the normal operating range by a selected margin. This feature of the invention may also be employed to perform other well servicing functions besides being used in establishing circulation through a faulty valve.

FIGS. 3 and 4 of the drawings illustrate exemplary cam slot patterns which may be formed on the inner surface of the valve housing 14*a* to provide a desired sequence of bypass valve opening and closing. FIG. 3 illustrates a slot pattern indicated generally at 120 which may be formed on the interior surface of the valve housing section 14*a* to provide a continuous sequence of open and closed bypass valve configurations. With joint reference to FIGS. 1 and 3, it will bee seen that with the key 19 engaged in the slot 120 at the initial position 120*a*, the valve 10 will be in its closed position. With the application of hydrostatic pressure, or with a sufficient fluid flow rate through the valve body, the sleeve assembly 11 shifts down and the key 19 rotates the sleeve assembly 11 as the key rides the slot down to the lower slot shift position 120*b*. When the hydrostatic or flow induced pressure is sufficiently relieved, the spring 17 urges the sleeve assembly 11 upwardly sending the key 19 up the slot pattern to the upper slot position 120*c* where the valve is held in its fixed open condition. A subsequent downward application of force on the sleeve 11 by the flow of fluid through the valve returns the sleeve assembly 11 down to a slot shift position 120*d*. When the pressure of the fluid in the valve is relieved, the spring 17 drives the sleeve assembly 11 back up causing the key 19 to move through the slot to a position 120*e* where the bypass of the valve is held in its fixed closed position. The described procedure is repeated to advance the key 19 to the slot positions 120*f*, 120*g*, 120*h* and then to 120*a* to complete a 360° revolution of the sleeve assembly 11 within the housing 14. It will be appreciated that the described cam pattern and sequence of control operations permits the bypass of the valve to be cycled as often as desired between open and closed positions.

FIG. 4 illustrates a variation in a cam slot design indicated generally at 220 which may be employed with the present invention to produce two closed conditions between each open condition of the bypass through the valve. The key 19 is advanced through the pattern 220 from a first position 220*a* wherein the bypass is closed by increasing the hydrostatic pressure or by increasing the flow rate through the valve housing to move the key to a shift position 220*b*, relieving the pressure to allow the spring to move the sleeve and key to a fixed closed position 220*c*, flowing the open valve to move the key 19 to a shift position 220*d*, relieving the hydrostatic pressure or reducing the flow rate through the valve body to move the key 19 to a fixed open bypass valve position 220*e*, increasing the flow to move the key 19 to a shift position 220*f* and reducing the hydrostatic pressure or flow rate to return the key 19 to the starting position 220*a*.

It will be understood that the illustrated cam patterns provide a valve bypass which will remain open at even high rates of fluid flow and high pressure differentials acting across the valve. The change in condition of the bypass from open to closed or closed to open requires a cycle of pressure increase followed by pressure decrease.

FIG. 5 of the drawings illustrates a preferred form of the cam slot pattern employed to perform a particular downhole servicing operation. A cam pattern, indicated generally as 320, provides multiple positions which mechanically hold the bypass of the valve either open or closed even in the absence of fluid flow through the valve. The pattern 320 also permits the application of high fluid rates and high fluid pressure to the equipment connected to the valve without shifting the valve from its open or closed positions. Thus, with the valve bypass in its open condition with the key 19 in a first position 320*a*, the bypass port 12, 13 is open. The sleeve will remain in the position 320*a* under the force of the spring 17 when there is no flow through the valve body. When fluid flow is initiated, the flow forces the key 19 down the cam slot to a position 320*b* where the bypass continues to remain open. Increased flow or pressure applied to the valve will have no effect in moving the sleeve from the slot position 320*b* so that the bypass remains open to permit high pressure and rapid flow rates to be used in circulating fluid through the open bypass.

When the flow rate is sufficiently reduced, the spring force pushes the sleeve /1 back up causing the key 19 to rotate through the cam pattern until it engages a cam position 320*c* where the bypass remains open. A subsequent increase in the flow rate shifts the key to cam position 320*d* where the bypass through the valve is closed. At this position, the flow rate and fluid pressure may be increased as much as desired without shifting the sleeve 11 to an open position. Once the flow rate or static fluid pressure is reduced, the spring force shifts the key 19 to cam position 320*e* where it is mechanically retained to keep the bypass in closed condition. Increasing the hydrostatic pressure of static fluid in the valve or increasing the flow rate of fluid through the valve pushes the sleeve 11 down against the spring force and rotates the key 19 into cam position 320*f* at which the bypass remains closed. When the pressure is relieved or the flow rate is reduced, the spring force moves the key to cam position 320*g* where the sleeve is mechanically held to keep the bypass closed. Subsequent application of pressure or flow rate increase moves the key to cam position 320*h* where, again, the flow rate or pressure may be increased as desired without shifting the bypass mechanism to its open position. A subsequent reduction in flow rate or pressure permits the spring force to return the key to the starting cam position 320*a*.

In fabricating the valve of the present invention, it will be appreciated that the dimensions and contours of the various cam slot patterns described herein must be made to correspond with the structure of the valve mechanism to produce the described operations.

In the method of the invention, the subsurface valve and equipment operated by the valve are manipulated by alternatively raising and lowering the pressure of the fluid within the valve. A bypass through the valve is shifted between positions where the bypass is held open or closed mechanically and intermediate positions where the bypass is held open or closed by the pressure of the fluid within the valve. Shifting between mechanically open or closed and pressure open or closed positions is controlled by alternately raising and lowering the flow rate or fluid pressure of the fluid in the valve.

The foregoing disclosure and description of the invention is illustrative and explanatory thereof, and it will be appreciated by those skilled in the art that various changes in the size, shape and materials as well as in the details of the illustrated construction or combinations of features of the various system elements and the method discussed herein may be made without departing from the spirit of the invention.

What is claimed is:

1. A bypass valve for positioning downhole in a well bore along a tubular string, the bypass valve being responsive to flow induced pressure changes transmitted to the valve through the tubular string to control the flow of fluid through the valve, comprising:

a generally tubular valve housing adapted for fluid communication with the tubular string;

a bypass valving mechanism positioned within said valve housing and axially movable within said valve housing between an open position which permits fluid flow through said valve housing and a closed position which terminates valve housing;

a flow responsive pressure differential member positioned within said valve housing and responsive to the flow of fluid through said valve housing for moving said valving mechanism axially within said valve housing;

a biasing member for providing a biasing force opposing axial movement of said valving mechanism in response to said pressure differential member; and a cam device within said valve housing for manipulating said valving mechanism between said open position and said closed position in response to axial movement of said valving mechanism within said housing.

2. The valve as defined in claim 1 further comprising:

a hydrostatic pressure differential member responsive to the pressure of static fluid within said valve housing for moving said valving mechanism axially within said valve housing and against said biasing force.

3. The valve as defined in claim 1 further comprising:

a first cam position in said cam device for holding said valving mechanism at said closed position which terminates flow through said valve housing; and a second cam position in said cam device for holding said valving mechanism at said open position which permits flow through said valve housing.

4. The valve as defined in claim 1 further comprising:

a secondary circulation control device responsive to the pressure of the fluid within said valve housing for establishing fluid communication with an area exterior of said valve housing when said pressure within said valve housing exceeds a normal operating pressure of said valve by a preselected amount.

5. The valve as defined in claim 1 wherein said flow responsive pressure differential member comprises:

a flow restriction ring removably positioned within said valve housing for moving said valving mechanism between said open position and said closed position for a selected fluid flow and pressure condition in said valve housing.

6. The valve as defined in claim 1 wherein: said biasing member comprises a coil spring.

7. The valve as defined in claim 1 wherein:

said cam device includes a slot pattern formed internally of said tubular housing; and said valving mechanism includes a key adapted to slide through said slot pattern in said valve housing whereby movement of said valving mechanism between said open position and said closed position rotates said valving mechanism.

8. The valve as defined in claim 2 wherein said hydrostatic pressure differential member includes multiple sliding sealing areas of different cross-sectional dimensions whereby a net pressure induced force is created in response to the application of fluid pressure in said valve housing causing said valving mechanism to move axially within said housing.

9. The valve as defined in claim 2 wherein said flow responsive pressure differential member comprises:

a flow restriction ring removably positioned within said valve housing for moving said valving mechanism between said open position and said closed position for a selected fluid flow and pressure condition in said valve.

10. The valve as defined in claim 9 wherein said biasing member comprises a coil spring.

11. The valve as defined in claim 10 further comprising:

a first cam position in said cam device for holding said valving mechanism at said closed position which terminates flow through said valve housing; and a second cam position in said cam device for holding said valving mechanism at said open position which permits flow through said valve housing.

12. The valve as defined in claim 10 wherein:

said valve housing is a tubular housing;

said cam device includes a slot pattern formed internally of said tubular housing; and said valving mechanism includes a key adapted to slide through said slot pattern in said valve housing whereby movement of said valving mechanism between said open position and said closed position rotates said valving mechanism within said housing.

13. The valve as defined in claim 11 further comprising:

a secondary circulation control device responsive to the pressure of the fluid within said valve housing for establishing fluid communication with an area exterior of said valve housing when said pressure within said valve housing exceeds the normal operating pressure of said valve by a preselected amount.

14. A method of activating the bypass opening in a subsurface valve from a remote surface location, comprising:

selecting a flow restriction ring for positioning within said valve as a function of an anticipated fluid flow and pressure condition to the valve;

flowing fluid through the flow restriction ring in the valve at the anticipated rate sufficient to shift a flow responsive valve control mechanism from a first position wherein the bypass of the valve is open to a second position wherein the bypass remains open;

reducing the rate of fluid flow through the valve to shift the valve control mechanism from the second position to a third position wherein the bypass of the valve is closed;

increasing one of the hydrostatic pressure of static fluid in the valve and the rate of fluid flow through the valve to move the bypass valve control mechanism from the third position to a fourth position wherein the bypass is open;

reducing one of the hydrostatic pressure of static fluid in the valve and the rate of flow of fluid through the valve to move the bypass valve control mechanism from the fourth position to a fifth position wherein the bypass of the valve remains open; and circulating fluid from said valve through said bypass in said open position.

15. The method as defined in claim 14, further comprising:

biasing the valve control mechanism axially within a valve housing.

16. The method as defined in claim 15, further comprising:

shifting said valve control mechanism to a bypass open position at least twice before shifting said control mechanism to a bypass closed position.

17. The method as defined in claim 15, further comprising:

shifting said valve control mechanism to a bypass closed position at least twice before shifting said control mechanism to a bypass open position.

18. A method of operating a downhole subsurface valve from a remote surface location, the subsurface valve positioned in a wellbore along a tubular string, comprising:

initiating fluid flow through the tubular string and to said valve adequate to shift a flow responsive bypass valve closure mechanism in the valve from a first open position to a second open position;

reducing the pressure of the fluid in the tubular string and to the valve to mechanically shift the bypass valve closure mechanism to a third open position;

increasing the pressure of the fluid in the tubular string and to the valve to shift the bypass valve closure mechanism from said third open position to a first closed position; and lowering the pressure of the fluid in the tubular string and to the valve to allow the valve closure mechanism to shift the bypass to a mechanically retained second closed position.

19. The method as defined in claim 18, further comprising:

increasing the pressure of the fluid in the valve to move the valve closure mechanism to a third closed position;

reducing the pressure of the fluid in the valve to mechanically shift the bypass of the valve to a fourth closed position;

increasing the pressure of the fluid in the valve to move the valve closure mechanism to a fifth closed position; and reducing the pressure of the fluid in the valve to mechanically shift the bypass of the valve to said first open position.

20. The method as defined by claim 18, further comprising:

increasing the pressure of static fluid in the valve to shift the bypass mechanism from a closed to an open position.

21. The method as defined in claim 19, further comprising:

increasing the pressure of static fluid in the valve to shift the bypass mechanism from a closed to an open position.

22. The method as defined in claim 18, further comprising:

increasing the pressure of fluid within the valve to a value above normal operating ranges to open a secondary bypass through said valve.

23. A bypass valve for positioning downhole in a well bore along a tubular string, the bypass valve being responsive to flow induced pressure changes transmitted to the valve through the tubular string to control the flow of fluid through the valve, comprising:

a valve housing adapted for fluid communication with the tubular string;

a bypass valving mechanism movable within said valve housing between an open position which permits fluid flow through said valve housing and a closed position which terminates flow of fluid through said valve housing;

a flow responsive pressure differential member within said valve housing and responsive to the flow of fluid through said valve housing for moving said valving mechanism axially within said valve housing, the flow responsive differential member including a flow restrictive ring removably positioned within said valve housing for moving said valving mechanism between said open position and said closed position for a selected fluid flow and pressure condition in said valve housing;

a biasing member for providing a biasing force opposing axial movement of said valving mechanism in response to said pressure differential member; and a cam device within said valve housing for manipulating said valving mechanism between said open position and said closed position in response to axial movement of said valving mechanism within said housing.

24. The valve as defined in claim 23 further comprising:

a hydrostatic pressure differential member responsive to the pressure of static fluid within said valve housing for moving said valving mechanism axially within said valve housing and against said biasing force.

25. The valve as defined in claim 24 wherein said hydrostatic pressure differential member includes multiple sliding sealing areas of different cross-sectional dimensions whereby a net pressure induced force is created in response to the application of fluid pressure in said valve housing causing said valving mechanism to move axially within said housing.

26. The valve as defined in claim 23 further comprising:

a first cam position in said cam device for holding said valving mechanism at said closed position which terminates flow through said valve housing; and a second cam position in said cam device for holding said valving mechanism at said open position which permits flow through said valve housing.

27. The valve as defined in claim 23 further comprising:

a rupture disk responsive to the pressure of the fluid within said valve housing for establishing fluid communication with an area exterior of said valve housing when said pressure within said valve housing exceeds a normal operating pressure of said valve by a preselected amount.

28. The valve as defined in claim 23 wherein:

said valve housing is a tubular housing;

said cam device includes a slot pattern formed internally of said tubular housing; and said valving mechanism includes a key adapted to slide through said slot pattern in said valve housing whereby movement of said valving mechanism between said open position and said closed position rotates said valving mechanism within said housing.

* * * * *

UNITED STATES PATENT AND TRADEMARK OFFICE

CERTIFICATE OF CORRECTION

PATENT NO. : 5,609,178
DATED : March 11, 1997
INVENTOR(S) : Gregory E. Hennig and Gary J. Pape It is certified that error appears in the above-indentified patent and that said Letters Patent is hereby corrected as shown below:

In column 8, line 15, after "terminate" insert --flow of fluid through said--.

Signed and Sealed this

First Day of July, 1997

Bruce Lehman

*Attest:*

BRUCE LEHMAN

*Attesting Officer*

*Commissioner of Patents and Trademarks*